US008460045B2

(12) United States Patent
Böröczki et al.

(10) Patent No.: US 8,460,045 B2
(45) Date of Patent: Jun. 11, 2013

(54) HIGH INTENSITY DISCHARGE LAMP WITH ENHANCED DIMMING CHARACTERISTCS

(75) Inventors: Ágoston Böröczki, Rózsa (HU); Csaba Horváth, Juhász Gyula (HU)

(73) Assignee: General Electric Company, Schenectady, NY (US)

( * ) Notice: Subject to any disclaimer, the term of this patent is extended or adjusted under 35 U.S.C. 154(b) by 352 days.

(21) Appl. No.: 11/821,684

(22) Filed: Jun. 25, 2007

(65) Prior Publication Data

US 2008/0315769 A1 Dec. 25, 2008

(51) Int. Cl.

| | |
|---|---|
| ***H01J 9/00*** | (2006.01) |
| ***H01J 9/02*** | (2006.01) |
| ***H01J 17/06*** | (2006.01) |
| ***H01J 61/09*** | (2006.01) |

(52) U.S. Cl.
USPC ..... 445/22; 445/35; 313/618

(58) Field of Classification Search
USPC ..... 313/31, 344, 361
See application file for complete search history.

(56) References Cited

U.S. PATENT DOCUMENTS

| | | | | |
|---|---|---|---|---|
| 2,887,603 | A | 5/1959 | Haidinger | |
| 2,951,171 | A | 8/1960 | Holmes | |
| 3,132,409 | A * | 5/1964 | Freeman | 445/35 |
| 3,619,699 | A | 11/1971 | White | |
| 3,989,976 | A * | 11/1976 | Tabor | 315/291 |
| 4,097,977 | A * | 7/1978 | Pollner | 445/7 |
| 4,254,548 | A * | 3/1981 | Arakawa et al. | 29/879 |
| 5,210,463 | A * | 5/1993 | Fromm et al. | 313/631 |
| 5,357,167 | A * | 10/1994 | Mathews et al. | 313/632 |
| 5,499,937 | A * | 3/1996 | Stevens et al. | 445/49 |
| 5,742,125 | A * | 4/1998 | Ruigrok | 313/628 |
| 5,911,919 | A * | 6/1999 | Billings | 252/516 |
| 6,817,920 | B1 * | 11/2004 | Furuta et al. | 445/58 |
| 2002/0033672 | A1 | 3/2002 | Vos et al. | |
| 2006/0238127 | A1 | 10/2006 | Van Esveld et al. | |

FOREIGN PATENT DOCUMENTS

| | | |
|---|---|---|
| DE | 1 901 579 A1 | 10/1969 |
| GB | 1 240 069 A | 7/1971 |

OTHER PUBLICATIONS

PCT/US2008/064239 International Search Report, mailed Feb. 16, 2009.

* cited by examiner

*Primary Examiner* — Britt D Hanley
(74) *Attorney, Agent, or Firm* — Fay Sharpe LLP

(57) ABSTRACT

A high intensity discharge lamp comprises a discharge vessel and two electrode rods having substantially flat ends facing to each other in opposite positions within the discharge vessel. A spiral coil of wire is wound at least on a part of the surface of at least one of the electrode rods. The spiral coil protrudes over said end of the corresponding electrode rod and thus forms a hollow cavity for extending dimmable wattage range of the lamp.

20 Claims, 4 Drawing Sheets

HIGH INTENSITY DISCHARGE LAMP WITH ENHANCED DIMMING CHARACTERISTCS

FIELD OF THE INVENTION

This invention relates to high intensity discharge (HID) lamps, more particularly to HID lamps comprising an improved electrode for enhanced dimming characteristics of the lamp. The invention relates also to a manufacturing method of such improved electrodes.

BACKGROUND OF THE INVENTION

Most of the commercially available known HID lamps are used for several purposes, for example low power metal halide lamps are used for indoor lighting applications. HID lamps have electrodes without preheating features. The lamps have to start reliably with cold electrodes, and perform the specified electrical and light characteristics both initially and through their life after reaching steady-state operation temperatures. These requirements set different and often contradicting conditions to the electrode design.

In addition to these requirements, dimming is a great advantage in applications in which light output of the lamp has to be adjusted to some reduced value, or actual conditions allow reduction of lamp power and energy consumption.

The most important types of HID lamps are the high-pressure mercury, high-pressure sodium, metal halide, discharge automotive, and special type (projection, studio, etc.) lamps. Continuous mode dimming is particularly important in the low wattage range of HID lamps intended for interior lighting or possibly for vehicle lighting.

Conventional electrode designs allow dimming down only about to 60% of the nominal wattage, which makes them unusable for certain applications.

According to the solutions disclosed in U.S. Pat. Nos. 2,887,603 and 2,951,171, a special pair of electrodes is used in a lamp. One of them comprises a thorium-oxide emission material in a conical cavity. The other one discloses an electrode with coil that provides a nest for the emission material in order to reduce the loss rate thereof and consequently to lengthen the life of lamp.

Use of thorium-oxide as emission material in the form of tablet or pellet is indicated in U.S. Pat. No. 3,619,699 that relates to electrodes of discharge lamps. Penetration of the arc terminus into an electrode cavity is assisted by vapor breathing of the emission material, which injects plasma ingredients into the cavity during AC re-ignition after current zero. Such breathing is very desirable in high-pressure low-current lamps. Breathing is favored by a cavity, which has a depth not substantially greater than the terminus penetration depth. High temperatures deep within the cavity are advantageous, and are achieved by providing enhanced thermal coupling between the forward end of the cavity member and the cooler radiation shield surrounding it, and also by thermal insulation between the sides of the cavity member and the cooler shield. Disposing the emission material within the lower portion of the cavity favors deeper terminus penetration. Projection of the radiation shield beyond the cavity member is avoided because such projection would favor formation of a spot mode arc terminus on the shield.

This teaching provides hints to use a spiral member on the tip of the electrode, but the spiral member does not really form a cavity. The spiral member is used to make a reservoir for the emission material. The reservoir is not completely filled with the emission material, but an element that holds this material in place fills up the cavity completely. It is also complicated to manufacture such electrodes due to the emission material insert and large number of electrode components.

Another solution is known from the published patent application US 2006/0238127, in which the discharge vessel has a first and a second mutually opposed neck-shaped portion provided with a pair of electrodes, each of which is tubular over its entire length. The rod and spiral combination is declared in this document as having several drawbacks such as hardly controllable thermal contact between them. Therefore the electrode is manufactured with a tungsten tube mounted onto a tungsten rod with an intermediate member. A tungsten tube of small diameter is very expensive and requires non-conventional electrode manufacturing technology that may further increase the costs of production and may involve dimension-control issues primarily at electrodes of submillimeter size.

There is a need for HID lamps with cavity electrodes that require simple and cost effective manufacturing technology.

Recently emerging requirement is that HID lamps are dimmable with a continuous and wide range of wattage. There is a particular further need for meeting this requirement by suitable electrode structure.

SUMMARY OF THE INVENTION

In an exemplary embodiment of the present invention, there is provided a high intensity discharge lamp comprising a discharge vessel, two electrode rods having substantially flat ends facing to each other in opposite positions within the discharge vessel. A spiral coil of wire is wound at least on a part of the surface of at least one of the electrode rods. The spiral coil protrudes over said end of the corresponding electrode rod and thus forms a hollow cavity for extending dimmable wattage range of the lamp.

In an exemplary embodiment of another aspect of the present invention, an electrode for high intensity discharge lamps is provided. The electrode comprises an electrode rod having a substantially flat end. A spiral coil of wire is wound at least on a part of the surface of the electrode rod, and the spiral coil protrudes over said end of the electrode and thus forms a hollow cavity for extending dimmable wattage range of the lamp.

Finally a method for manufacturing such an electrode is provided, the method comprising the step of winding turns of at least one spiral coil layer of wire onto the surface of an electrode rod, while the spiral coil layers protrude over said end of the electrode rod, and thus a hollow cavity is formed.

In exemplary embodiments of the method, the spiral coil layers and turns thereof are pressed together in a press mould comprising a cylinder, an inner core and one or two concentric ring shaped movable pistons.

This invention has several advantages over the prior art. It broadens the dimmable wattage range of the HID lamps with respect to the dimmable wattage range of the known HID lamps significantly. The flexible cavity shape configuration of the lamp electrodes provides a better luminous efficiency; more well defined arc attachment and consequently more stable operation of the lamp. The electrode structure of this invention can be produced by only minor modifications applied to the existing technologies of manufacture, which in turn results in cheap and easy production of the lamp.

BRIEF DESCRIPTION OF THE DRAWINGS

The invention will now be described in detail with reference to the enclosed drawing, in which.

DETAILED DESCRIPTION OF THE INVENTION

Figure 1:
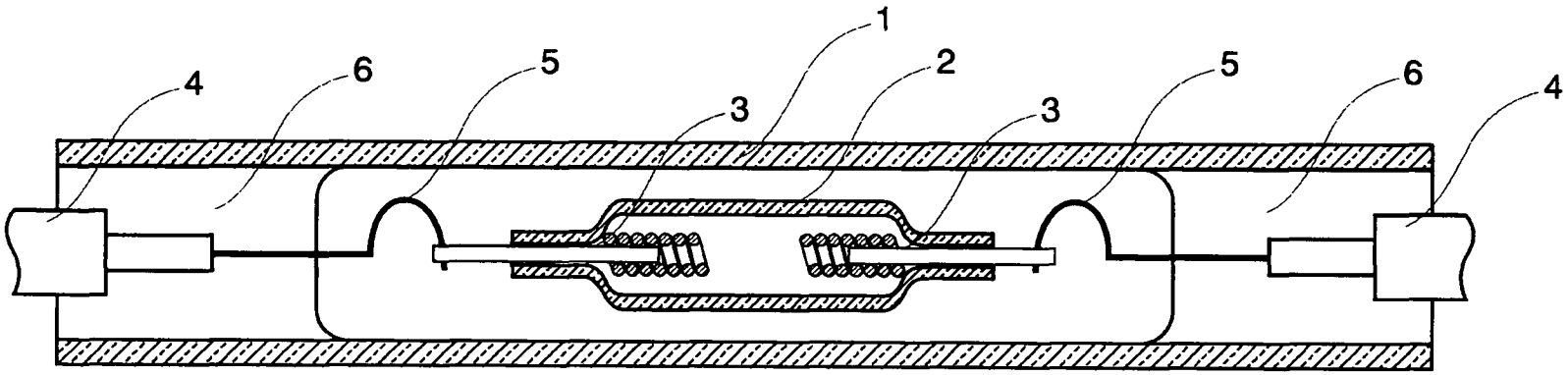
FIG. 1 is a side view in cross section, showing an exemplary embodiment of a HID lamp of the invention that includes a discharge vessel.

Referring first to FIG. 1, a high intensity discharge lamp, or as commonly referred to a HID lamp is shown. The lamp has an outer envelope 1 that includes a discharge vessel 2, which is connected by lead-in wires 5 to electric terminals 4 in pinch portions 6. The discharge vessel 2 comprises two electrodes 3. The discharge vessel 2 may be, for example, made of quartz glass however other suitable materials may also be used, e.g. polycrystalline alumina, yttrium-aluminum-garnet, AlN. The outer envelope 1 may for example be made of hard glass, quartz glass, or doped versions thereof in order to accomplish proper degree of filtering of the UV radiation emitted by the discharge in the vessel.

Figure 2:
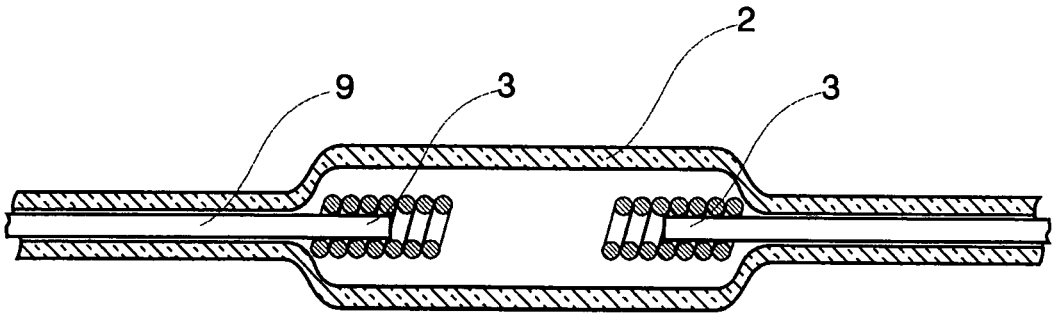
FIG. 2 is a side view in cross section, showing the discharge vessel of FIG. 1.

The discharge vessel 2 is illustrated in FIG. 2. It may be filled with any known substances, which are widely used in HID lamps, for example rare gas, sodium, metal-halides, mercury or materials replacing mercury, e.g. $ZnI_2'.AlI_3$. Two electrodes 3 have free ends facing to each other in opposite positions within the discharge vessel. The arrangement is commonly used for other HID lamps.

Figure 3:
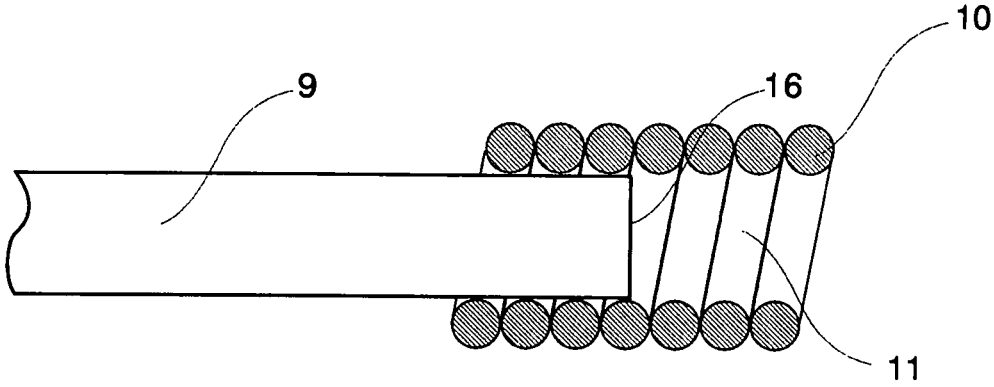
FIG. 3 is a side view in cross section, showing the end part of an electrode of the lamp of FIG. 1.

FIG. 3 shows an end part of one of the electrodes 3 of the lamp of FIG. 1. In FIG. 3, there is an electrode rod 9 made of tungsten or tungsten alloy. The latter may comprise 1-3% by weight of certain oxides of one or more metals selected from the group including for example thorium, hafnium and cerium. This type of material is commonly used for discharge lamp electrodes. A spiral coil 10 of tungsten or tungsten alloy wire is wound on a part of the surface of at least one of the electrode rods 9. The tungsten alloy wire may comprise the same additive materials as the material of the electrode rod 9. The part of the surface with the wound wire is near the free end of the electrode rod 9 where it is terminated in a substantially flat end 16 towards the discharge space. The spiral coil 10 is protruding over the end 16 of the electrode rod 9. Thus a hollow cavity 11 has been formed in order to obtain an extended dimmable wattage range of the HID lamp.

Figure 4:
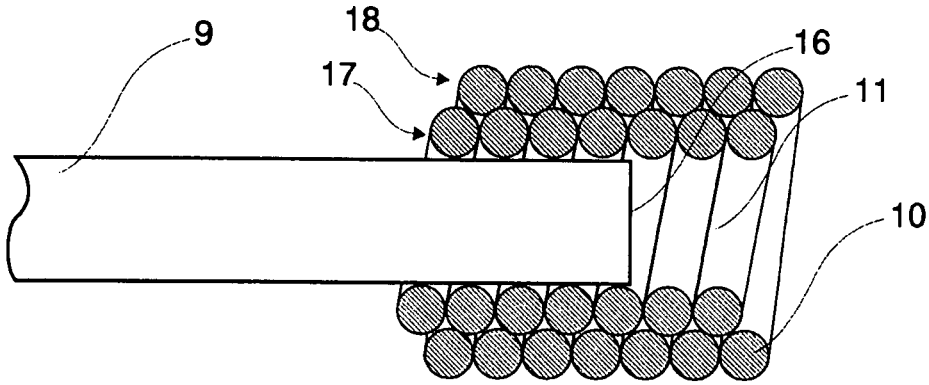
FIG. 4 is a side view in cross section, showing one another embodiment of an electrode according to the invention.

FIG. 4 shows the end part of another alternative kind of the hollow electrode. This is very similar to the version illustrated in FIG. 3 with the difference that the spiral coil 10 includes two layers. The first layer 17 is wound onto an electrode rod 9 in the same manner as in the embodiment of FIG. 3. An outer second layer 18 is, however, wound directly onto the first layer 17. The two layers 17 and 18 together provide better design flexibility for electrode thermal mass and greater mechanical stability at the same time. The hollow cavity 11 has also been formed in this embodiment and ensures the desired operation features.

Figure 5:
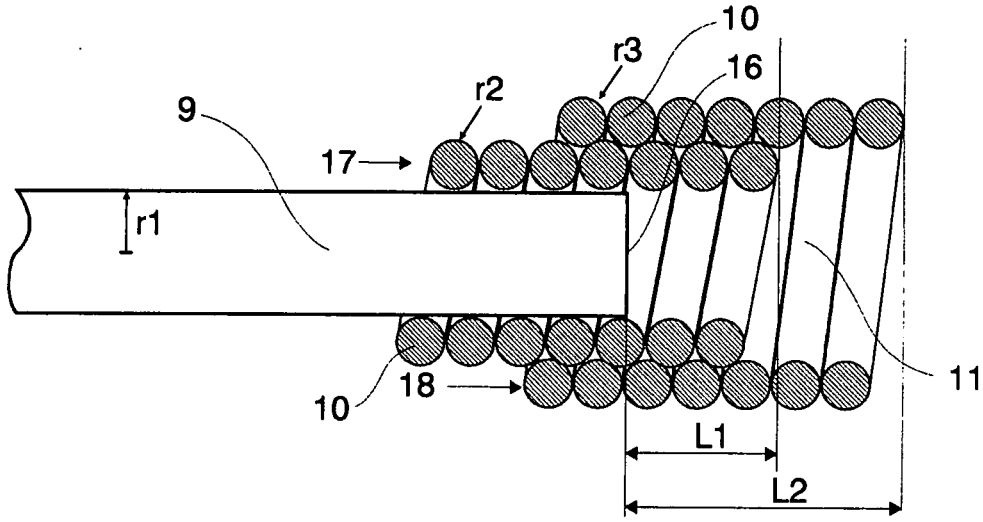
FIG. 5 is a side view in cross section, showing one further embodiment of the electrode.
Figure 6:
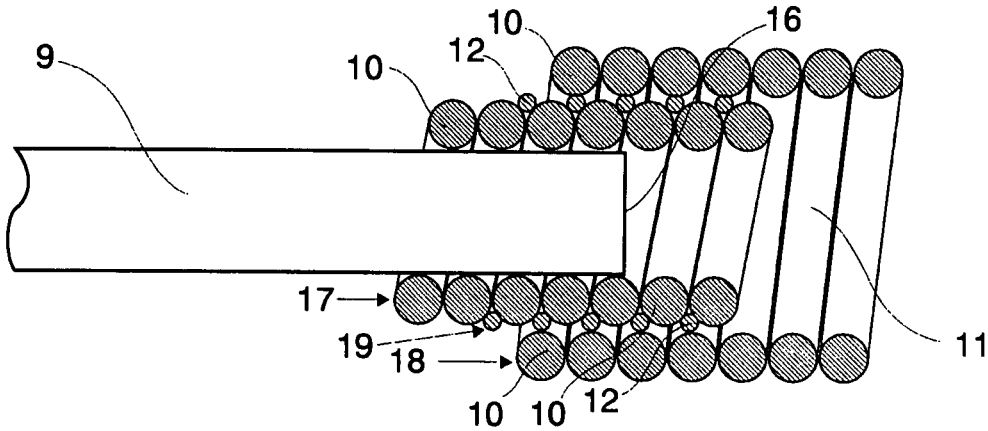
FIG. 6 is a side view in cross section, showing a still further embodiment of the electrode.

Two modified embodiments of this last two-layer type electrode follow in the illustrations of FIGS. 5 and 6.

In FIG. 5, the second layer 18 is shifted towards the free end of the electrode relative to the first layer 17. This results in a different shape of the cavity 11 having a funnel-like widened throat portion. It has been experienced that this shape also promotes the obtainable extended dimmable range significantly. The funnel-like widened throat portion of the cavity 11 actually comprises an inner portion of a length L1 and an outer widened portion. A total length of the hollow cavity 11 is L2. The measure of widening in the throat portion is determined in this illustrated embodiment by the radius r2 of the wire in the first layer 17. The widening is equal to four times r2 in this case since the diameter of the wires of the two coils are same. The widening may however grow in subsequent turns of the coil in the second layer 18 while moving away from the end 16 of the electrode rod 9. This results in a conical funnel-like widening throat portion. This possible embodiment is not illustrated by a separate drawing figure.

The radius r3 of the wire in the second layer 18 can be substantially identical with or different from the radius r2 of the wire in the first layer 17. As a common practical rule for the sizes, it can be suggested that radiuses r2 and r3 of the wires of the spiral coils be less than ⅗ of the radius r1 of the corresponding electrode rod 9 of cylindrical shape. This rule originates from constraints of state-of-art manufacturing technology.

FIG. 6 shows a version of FIG. 5 completed with a third layer 19. The second layer 18 in this case is also protruding over the end 16 of the corresponding electrode rod with a greater length than the first layer 17. The third layer 19 is made of tungsten or tungsten alloy wire, which is wound between the first and second layers 17 and 18, and the radius of the wire in the third layer is smaller than the radius of the wire in the first and second layers 17 and 18. The radius can be, for example, optimized by the geometry, i.e. by the radiuses r2 and r3. Due to this arrangement, the filling of space between the wires of spiral coils 10 can be better than in the previous embodiment. The third layer 19 may extend to the whole outer side of the first layer 17 and not only for the portion overlapping the second layer 18. Emission material can also be dispensed between the coil turns rather than adding it to the material of the electrode rod or the spiral coil in alloy form.

In the course of manufacturing, a step of winding turns of at least one spiral coil layer of tungsten or tungsten alloy wire onto the surface of an electrode rod 9 is implemented while the resultant spiral coil layers will protrude over the end 16 of the electrode rod 9 and thus the hollow cavity 11 will be formed.

Figure 7:
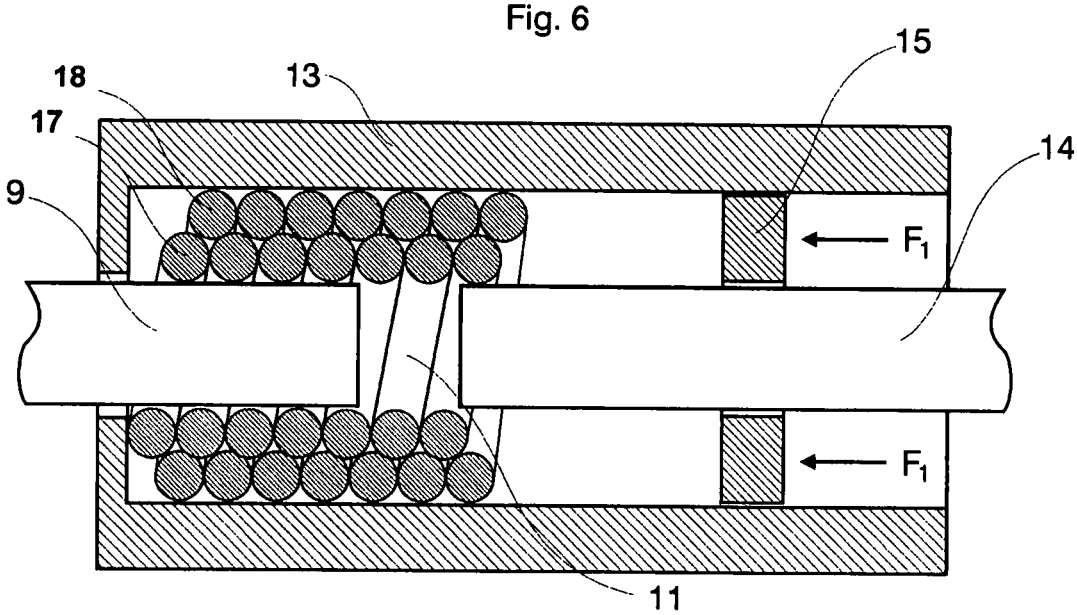
FIG. 7 is a side view in cross section, showing schematically a pressing arrangement used in manufacturing of the electrode.
Figure 9:
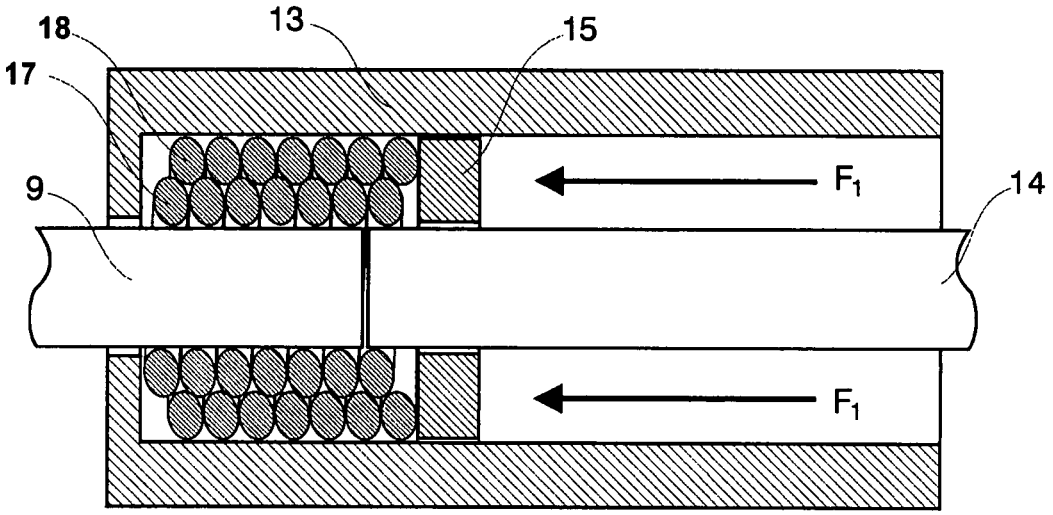
FIG. 9 is a side view in cross section, showing schematically the arrangement of FIG. 7 after pressing.

The end part of the electrode is thus made of spiral coils 10. This means that the electrical and mechanical contact between the neighboring turns of the coil may occasionally be insufficient. In order to enhance the quality of the contact, the spiral coil layers and the turns thereof may be pressed together during manufacture. FIG. 7 schematically shows a pressing arrangement used for this purpose. A cylinder 13 has an inner diameter substantially equal to the outer diameter of the second layer 18 to provide support during pressing. For the same reason, an inner core 14 is pushed into the cavity 11. The inner core 14 provides inner support for the first layer 17. In the event that the first and second layers 17 and 18 protrude over the end 16 of the corresponding electrode rod 9 in the same length, the only necessary pressing element is a ring shaped piston 15 disposed around the inner core 14. The ring shaped piston 15 is movable along the inner core 14. If one applies a force $F_1$ to the piston 15, the turns of the spiral coils 10 become deformed to some extent, as it is illustrated in FIG. 9. The result is a denser electrode end part structure, which is more resistant to the discharge during operation of the lamp.

Figure 8:
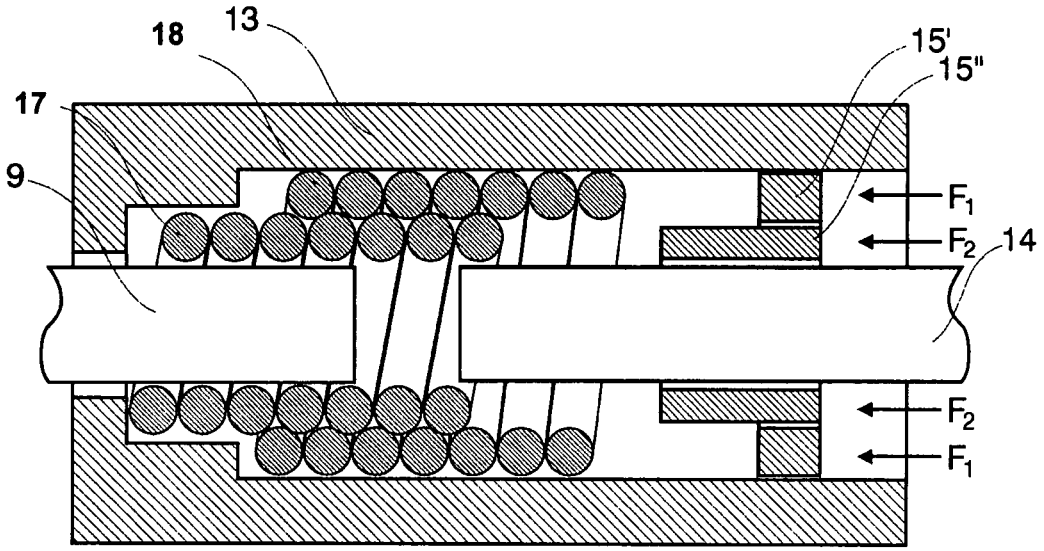
FIG. 8 is a side view in cross section, showing schematically a further pressing arrangement used in manufacturing of the electrode.

The layer structure of FIG. 5 requires a different pressing tool as shown in FIG. 8. Since the protruding lengths L1 and L2 are different, two concentric ring shaped pistons 15' and 15" around the inner core 14 are appropriate. Corresponding forces $F_1$ and $F_2$ are to be applied, respectively, in a way independent from each other.

Figure 10:
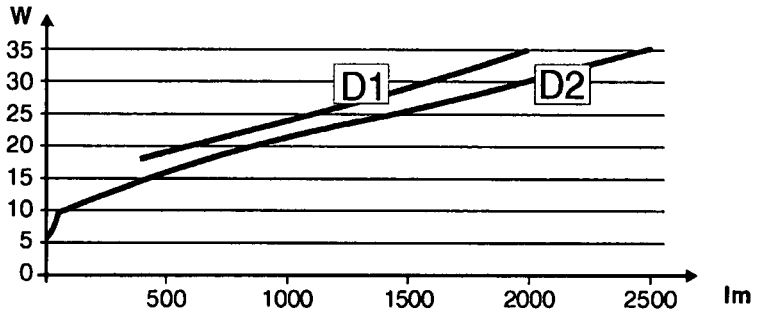
FIG. 10 is diagram comparing the dimmable wattage ranges of a known lamp and an invented lamp.

In the diagram of FIG. 10, the dimmable wattage ranges of a known HID lamp without cavity 11 (D1) and a HID lamp with cavity 11 according to an exemplary embodiment of the present invention (D2) are compared. The two HID lamps had the same nominal wattage value. It can be seen that the dimmable wattage range starts from a considerably lower value in case of D2 than in case of D1. Furthermore, the lm/W efficiency is also better for D2. The extended dimmable wattage range of the lamp comprises at least 10-100% of the nominal wattage. It is usually possible to obtain stable operation in the whole range of 5-100% of the nominal power, which results dimming capability in 1-100% of the nominal lamp lumen output. This was not possible by using any known HID electrodes.

The two electrodes of FIG. 2 are both of the kind according to an embodiment of the invention. It is, however, possible to use one traditional electrode without the hollow cavity and one electrode according to an embodiment of the invention.

The invention is not limited to the shown and disclosed embodiments, but other elements, improvements and variations are also within the scope of the invention. For example, it is clear for those skilled in the art that different cross-section shapes of the electrode rod, such as polygonal cross-section, may also be applicable for the purposes of the present invention.

The invention claimed is:

1. A method for manufacturing an electrode for high intensity discharge lamps having an electrode rod including a substantially flat end, a spiral coil of wire wound at least on a part of the surface of the electrode rod, the spiral coil having first and second layers protruding over said end of the electrode rod and thus forming a vacant, hollow cavity extending from the substantially flat end of the electrode rod comprising:

winding turns of at least one spiral coil layer of wire onto the surface of the electrode rod, the spiral coil layers protruding over said end of the electrode rod and thus forming the vacant, hollow cavity, positioning at least a portion of the first layer to extend axially beyond the substantially flat end of the electrode rod, further positioning the outer, second layer radially overlapping at least part of the first layer and radially overlapping at least part of the electrode rod, and at least a portion of the second layer extending axially beyond the substantially flat end of the electrode rod, and pressing the spiral coil layers and the turns thereof together to enhance electrical and mechanical contact between neighboring turns of the spiral coil layers.

2. The method of claim 1 comprising using a press mould including a cylinder, an inner core and a ring shaped movable piston.

3. The method of claim 1 comprising using a press mould including a cylinder, an inner core and two concentric ring shaped movable pistons.

4. The method of claim 1 further comprising adding an emission material to one of the electrode rod and the spiral coil layers.

5. The method of claim 4 wherein the emission material adding step includes dispensing the emission material between the coil turns.

6. The method of claim 4 wherein the emission material adding step includes including the emission material in alloy form in the electrode rod.

7. The method of claim 4 wherein the emission material adding step includes including the emission material in alloy form in the spiral coil.

8. A high intensity discharge lamp comprising a discharge vessel having an electrode manufactured according to the method of claim 1.

9. The high intensity discharge lamp of claim 8, wherein the lamp includes first and second electrodes, each electrode including an electrode rod, both electrode rods provided with spiral coils protruding over said ends of the corresponding electrode rods and thus forming hollow cavities.

10. The high intensity discharge lamp of claim 8, in which a third layer of wire is wound between the first and second layers, and the radius of the wire of the third layer is smaller than the radiuses of the wires in the first and second layers.

11. The high intensity discharge lamp of claim 8, in which the radiuses of the wires in the first and second layers are substantially identical.

12. The high intensity discharge lamp of claim 8, in which the electrode rod is of cylindrical shape.

13. The high intensity discharge lamp of claim 12, in which the radius of the wire of the spiral coil is less than ⅗ of the radius of the corresponding electrode rod.

14. The high intensity discharge lamp of claim 8, in which the extended dimmable wattage range of the lamp comprises at least 10-100% of the nominal wattage.

15. The high intensity discharge lamp of claim 8, in which an emission material is applied to a space between turns of the spiral coil.

16. The electrode of claim 8, in which the electrode rod is made of tungsten.

17. The electrode of claim 8, in which the electrode rod is made of tungsten alloy.

18. The electrode of claim 17, in which the material of the electrode rod is a tungsten alloy comprising 1-3% by weight of oxides of at least one of the metals including thorium, hafnium and cerium.

19. The electrode of claim 8, in which the spiral coil is made of one of tungsten and tungsten alloy.

20. The electrode of claim 8, in which the material of the spiral coil is a tungsten alloy comprising 1-3% by weight of oxides of at least one of the metals including thorium, hafnium and cerium.

* * * * *